US010316391B2

(12) United States Patent
Abayaweera et al.

(10) Patent No.: US 10,316,391 B2
(45) Date of Patent: Jun. 11, 2019

(54) METHOD OF PRODUCING TITANIUM FROM TITANIUM OXIDES THROUGH MAGNESIUM VAPOUR REDUCTION

(71) Applicant: Sri Lanka Institute of Nanotechnology (PVT) Ltd., Walgama, Malwana (LK)

(72) Inventors: Gayani Abayaweera, Homagama (LK); Gehan Amaratunga, Homagama (LK); Niranjala Fernando, Homagama (LK); Veranja Karunaratne, Homagama (LK); Nilwala Kottegoda, Homagama (LK); Ruwini Ekanayake, Homagama (LK)

(73) Assignee: Sri Lanka Institute of Nanotechnology (PVT) Ltd., Walgama, Malwana (LK)

( * ) Notice: Subject to any disclaimer, the term of this patent is extended or adjusted under 35 U.S.C. 154(b) by 117 days.

(21) Appl. No.: 15/226,763

(22) Filed: Aug. 2, 2016

(65) Prior Publication Data

US 2018/0037974 A1 Feb. 8, 2018

(51) Int. Cl.

| | |
|---|---|
| ***C22B 3/06*** | (2006.01) |
| ***C22B 3/08*** | (2006.01) |
| ***C22B 3/10*** | (2006.01) |
| ***C22B 5/12*** | (2006.01) |
| ***C22B 34/12*** | (2006.01) |

(52) U.S. Cl.

CPC ..... *C22B 34/1277* (2013.01); *C22B 3/065* (2013.01); *C22B 3/08* (2013.01); *C22B 3/10* (2013.01); *C22B 5/12* (2013.01); *C22B 34/1268* (2013.01); *C22B 34/1286* (2013.01)

(58) Field of Classification Search

CPC .... C22B 34/1268; C22B 34/1277; C22B 5/12

See application file for complete search history.

(56) References Cited

U.S. PATENT DOCUMENTS

| | | | | |
|---|---|---|---|---|
| 2,205,854 A | | 6/1940 | Kroll | |
| 2,834,667 A | * | 5/1958 | Rostron | C22B 34/1268 419/33 |
| 6,171,363 B1 | | 1/2001 | Shekhter et al. | |

(Continued)

FOREIGN PATENT DOCUMENTS

| | | |
|---|---|---|
| JP | 2003-105457 A | 4/2003 |
| JP | 2005-089830 A | 4/2005 |

(Continued)

OTHER PUBLICATIONS

Fang, Zhigang Zak, et al., "A New, Energy-Efficient Chemical Pathway for Extracting Ti Metal from Ti Minerals", *Journal of American Chemical Society*, Nov. 20, 2013, pp. 18248-18251, ACS Publications, US.

(Continued)

*Primary Examiner* — C Melissa Koslow

(74) *Attorney, Agent, or Firm* — Alston & Bird LLP

(57) ABSTRACT

Disclosed herein is a novel approach to the chemical synthesis of titanium metal from a titanium oxide source material. In the approach described herein, a titanium oxide source is reacted with Mg vapor to extract a pure Ti metal. The method disclosed herein is more scalable, cheaper, faster, and safer than prior art methods.

18 Claims, 16 Drawing Sheets

(56) References Cited

U.S. PATENT DOCUMENTS

| | | | |
|---|---|---|---|
| 2013/0164167 | A1 | 6/2013 | Cox et al. |
| 2016/0194733 | A1 | 7/2016 | Fang et al. |

FOREIGN PATENT DOCUMENTS

| | | | |
|---|---|---|---|
| JP | 2005-194554 | A | 7/2005 |
| WO | WO 1999/64638 | A1 | 12/1999 |

OTHER PUBLICATIONS

International Searching Authority, International Search Report and Written Opinion for International Application No. PCT/IB2017/054541, dated Nov. 13, 2017, 10 pages, Korean Intellectual Property Office, Republic of Korea.

Ismail, M., et al., "The upgrading of ilmenite from Sri Lanka by the oxidation-reduction-leach process", *International Journal of Mineral Processing*, Mar. 1983, pp. 161-164, vol. 10, issue 2, Elsevier, Netherlands.

Okabe, H., et al., "Titanium powder production by preform reduction process (PRP)", *Journal of Alloys and Compounds*, Feb. 2004, pp. 156-163, vol. 364, Elsevier, Netherlands.

www.alibaba.com, Jan. 25, 1999 to May 2, 2018, Internet Archive https://web.archive.org/web/*/http://www.alibaba.com, 7 pages.

www.lankamineralsands.com/index.php/products, Jan. 5, 2015 to Oct. 11, 2017, Internet Archive https://web.archive.org/web/*/http://www.lankamineralsands.com/index.php/products.

* cited by examiner (a)

(b)

(a)

(b)

METHOD OF PRODUCING TITANIUM FROM TITANIUM OXIDES THROUGH MAGNESIUM VAPOUR REDUCTION

FIELD

This invention relates to the chemical synthesis of titanium metal. Specifically, as compared to prior art methods, the invention disclosed herein provides a simple, efficient, cost-effective method of producing high quality titanium metal while preventing the need for long-duration reaction times or the creation of corrosive intermediates.

BACKGROUND

Titanium is an important metal commonly used in industry due to its desirable properties such as light mass, high strength, corrosion resistance, biocompatibility and high thermal resistivity. Thus, titanium has been identified as a material suitable for a wide variety of chemical, aerospace, and biomedical applications.

Titanium typically exists in nature as $TiO_2$, more specifically as ilmenite (51% $TiO_2$) and rutile (95% $TiO_2$). Ilemenite and rutile are examples of a "titanium oxide source" material. In $TiO_2$ the oxygen is dissolved into a Ti lattice to form an interstitial solid solution. It is difficult to remove oxygen in a Ti lattice since the thermodynamic stability of the interstitial oxygen is extremely high. Historically, the production of Ti metals from an ore containing $TiO_2$ has been achieved through a reduction process.

There are several approaches that have been reported to reduce a Ti ore to a Ti metal. One of the oldest methods, which is still being used in industry, is the Kroll process. The Kroll process was invented by Wilhelm Kroll and is described in 1983 in U.S. Pat. No. 2,205,854 titled Method for Manufacturing Titanium and Alloys Thereof. In the Kroll Process titanium containing ores such as refined rutile or ilmenite are reduced at 1000° C. with petroleum-derived coke in a fluidized bed reactor. Next, chlorination of the mixture is carried out by introducing chlorine gas, producing titanium tetrachloride $TiCl_4$ and other volatile chlorides. This highly volatile, corrosive intermediate product is purified and separated by continuous fractional distillation. The $TiCl_4$ is reduced by liquid magnesium (15-20% excess) at 800-850° C. for 4 days in a stainless steel retort to ensure complete reduction according to the following formula: $2Mg(l)+TiCl_4(g)\rightarrow 2MgCl_2(l)+Ti(s)$ [T=800-850° C.]. The resulting product is a metallic titanium sponge, which can be purified by removing $MgCl_2$ through vacuum distillation. This process takes 4 days.

In a similar, and slightly older approach (Hunters process), reduction of the $TiCl_4$ intermediate is carried out using sodium metal. Both the Kroll process and Hunter's process are costly, use high temperatures and corrosive intermediates and require long processing durations of between 4-10 days.

To overcome these drawbacks and to improve the productivity and to reduce the cost, another method, which used electrolysis was developed by Derek John Fray, Thomas William Farthing, and Zheng Chen (herein the "FFC process"). The FFC process was described in 1999 in an application titled Removal of Oxygen from Metal Oxides and Solid Solutions by Electrolysis in a Fused Salt published as WO1999064638 A1.

In the FFC process, molten calcium chloride is used as an electrolyte, $TiO_2$ pellets are placed at the cathode and graphite is used as the anode. Elevated temperatures around 900-1000° C. are used to melt the calcium chloride since its melting point is 772° C. A voltage of 2.8-3.2 V is applied, which is lower than the decomposition voltage of $CaCl_2$. When the voltage is applied at the cathode, oxygen in the $TiO_2$ abstracts electrons and is converted into oxygen anions and passes through the $CaCl_2$ electrolyte to the graphite anode forming $CO/CO_2$ gas. In this reduction process titanium +4 is reduced to titanium 0 (i.e., metallic titanium). The pellet created in this electrolysis is then crushed and washed with HCl and consecutively with distilled water to remove the $CaCl_2$ impurities. The resulting product is titanium metal.

Although, it was once anticipated that the FFC process would largely replace the Kroll process, there remain unresolved issues that limit its practical implementation. Some of the major drawbacks include the required use of a large amount of molten salt, slow reaction rates, the creation of undesirable intermediate products $CaTiO_3$, $Ti_3O_5$, $Ti_2O_3$ and TiO, an impure final product and difficulties in process scalability.

In 2004, a method for creating titanium powder through calcium vapour reduction of a $TiO_2$ preform was described in the *Journal of Alloys and Compounds* titled "Titanium powder production by preform reduction process (PRP)." In that method, a calciothermic reduction was performed on a $TiO_2$ preform, which was fabricated by preparing a slurry of $TiO_2$ powder, flux ($CaCl_2$ or CaO), and collodion binder solution. The resulting preform was sintered at 800° C. for 1-2 h to remove binder and water before reduction. This sintered $TiO_2$ preform was suspended over a bed of calcium shots in a sealed stainless steel reaction container. Next, the sealed reaction chamber was heated to 1000° C. where the preform was reacted with calcium vapour for 6-10 h. After cooling, the preform was dissolved in acetic acid to remove the flux and excess reductant. The resulting titanium metal was purified by rinsing with HCl, distilled water, alcohol, and acetone and then dried in vacuum. This process has several notable drawbacks including a necessarily long reaction time of 6-10 h and the undesirable formation of impurities such as $CaTiO_3$, $Ti_3O_5$, $Ti_2O_3$ and TiO.

Magnesium vapour has been used to reduce certain metals. For example, U.S. Pat. No. 6,171,363 (the "'363 patent") describes a method for producing Tantalum and Niobium metal powders by the reduction of their oxides with gaseous magnesium. In the process of the '363 patent, with respect to the production of tantalum powder, tantalum pentoxide was placed on a porous tantalum plate which was suspended above magnesium metal chips. The reaction was maintained in a sealed container at 1000° C. for at least 6 h while continuously purging argon. Once the product was brought to room temperature passivation of the product was done by introducing argon/oxygen mixtures, containing 2, 4, 8, 15 inches (Hg, partial pressure) of $O_2(g)$, respectively, into the furnace. Each gas mixture was in contact with powder for 30 minutes. The hold time for the last passivation with air was 60 minutes. Purification of tantalum powder from magnesium oxide was done by leaching with dilute sulfuric acid and next rinsed with high purity water to remove acid residues. The product was a free flowing tantalum, black powder.

In 2013, a process was presented in a *Journal of the American Chemical Society* article titled "A New, Energy-Efficient Chemical Pathway for Extracting Ti Metal from Ti Minerals" that described using magnesium hydride to produce titanium from titanium slag. In that method Ti-slag was used which contained 79.8% total $TiO_2$ (15.8% $Ti_2O_3$ reported as $TiO_2$), 9.1% FeO, 5.6% MgO, 2.7% $SiO_2$, 2.2%

$Al_2O_3$, 0.6% total other metal oxides. The Ti-slag was ball milled for 2 h with a eutectic mixture of 50% NaCl and $MgCl_2$. Prior to adding the eutectic mixture, it was melted, cooled and crushed. Next $MgH_2$ was mixed into the mixture for an hour in a laboratory tumbler. This mixture was heated in a tube furnace at 500° C. for 12-48 h in a crucible while purging hydrogen at 1 atm. The reduced product was leached in $NH_4Cl$ (0.1 M)/$NaC_6H_7O_7$ (0.77 M) solution at 70° C. for 6 h, this washing step is done to remove the produced MgO. Next the product was rinsed with water and ethanol and then with NaOH (2 M) solution at 70° C. for 2 h, to remove any silicates. Next it was rinsed again and was leached with HCl (0.6 M) at 70° C. for 4 h, to remove the remaining metal oxides such as Fe. The produced $TiH_2$ was rinsed again and was dried in a rotary drying kiln. The $TiH_2$ powder was dehydrogenated at 400° C. in an argon atmosphere to produce Ti metal.

Each of the above-described methods presents one or more undesirable drawbacks, including but not limited to, the creation of undesirable impurities, the use of high temperatures, long reaction times, scaling constraints, and the formation of corrosive, dangerous intermediaries.

SUMMARY

Disclosed herein is a novel approach to the chemical synthesis of titanium metal from a titanium oxide source such as natural and synthetic rutile, ilmenite (e.g., an iron removed ilmenite sand), anatase, and any oxide or sub oxide or mixed oxide of Ti. The method disclosed herein is more scalable, cheaper, faster and safer than prior art methods. In the approach described herein, a titanium oxide source is reacted with Mg vapour to extract a pure Ti metal.

In an embodiment of the inventive process, a composition comprising a titanium oxide source is loaded into a reaction chamber along with an excess of a composition comprising an Mg source, such as Mg powder, Mg granules, Mg nanoparticles, or Mg/Ca eutectics. It is preferable that reduction of composition comprising a titanium oxide source proceeds without direct physical contact between the composition comprising an Mg source in order to reduce the potential for contamination of the resulting titanium product. The reaction chamber is then sealed with a lid, saturated with a noble gas, and heated to an internal temperature of 800-1000° C. As long as the temperature is sufficient to vapourize Mg, the reaction will occur. The reaction is carried out for at least 30 minutes, and preferably between ~30 minutes-120 minutes. Then, the reaction chamber is cooled to room temperature, and the resulting products is washed with one or more washing media including but not limited to dilute acids (such as HCl, $HNO_3$, and $H_2SO_4$) and water (e.g., deionized water). In other embodiments, $Mg^{2+}$ impurities can be removed by ultra sound assisted water or dilute acid washing. The resulting product is then dried.

In other embodiments, the exemplary reaction described above is modified by varying the reaction temperature and time, and reactant molar ratios. For example, a slightly lower or higher temperature or slightly shorter or longer reaction times can be used and fall within the scope of the inventive process described herein.

In comparison to other titanium producing methods such as the Kroll process, the FFC process, the above-described magnesium vapour method is much more efficient since the time needed to reduce the titanium oxide source to Ti is low, noncorrosive materials are used, and titanium suboxide intermediates are avoided. The above-described method is viewed as suitable for the mass scale production of highly pure titanium metal.

DETAILED DESCRIPTION

The following description provides detailed embodiments of various implementations of the invention described herein. After reading this description, it will become apparent to one skilled in the art how to implement the invention in various alternative embodiments and alternative applications. However, although various embodiments of the present invention will be described herein, it is understood that these embodiments are presented by way of example only, and not limitation. As such, the detailed description of various alternative embodiments should not be construed to limit the scope or the breadth of the invention.

Figure 1:
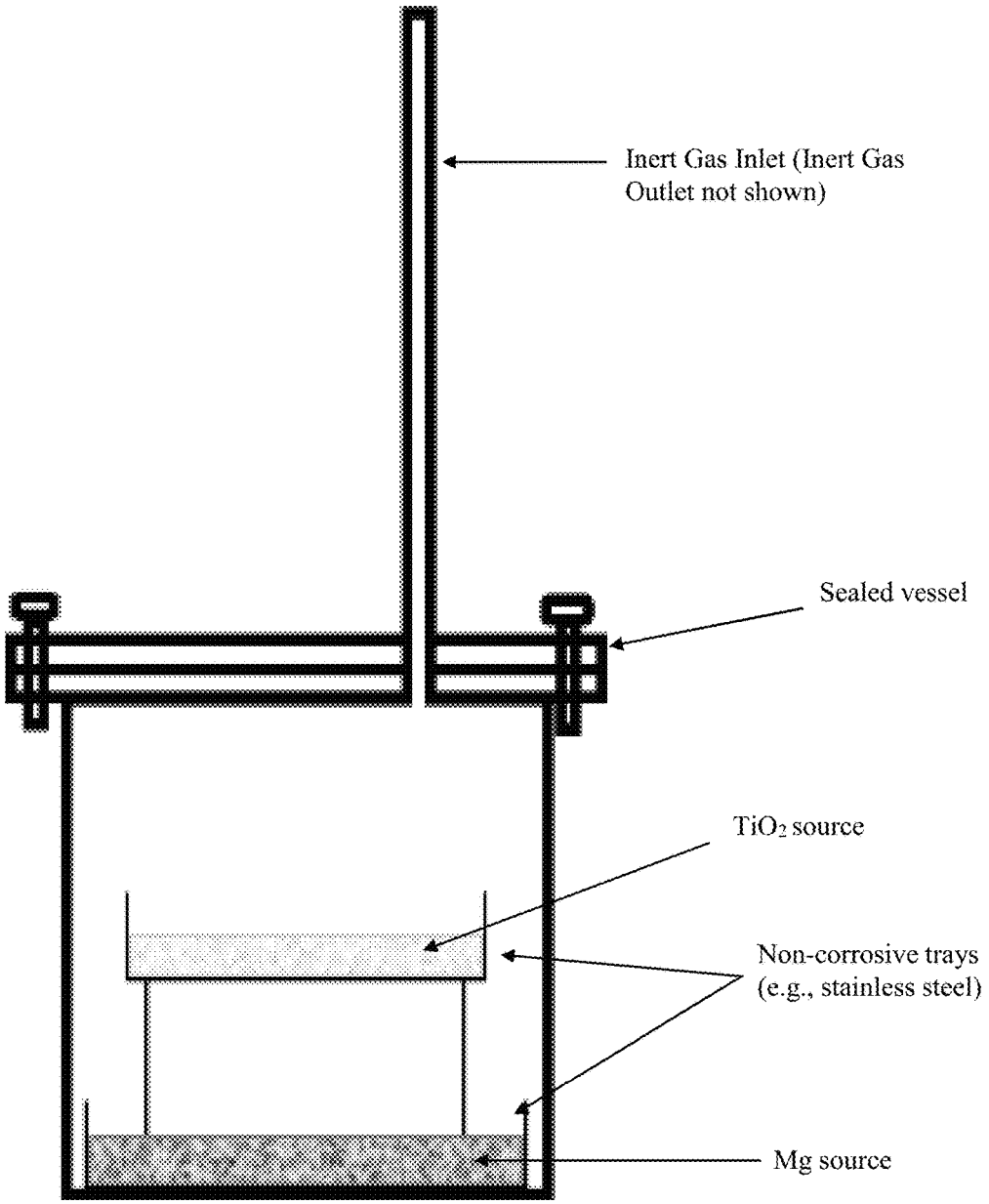
FIG. 1 is a schematic illustration of the experimental set-up used for $TiO_2$ reduction process
Figure 2:
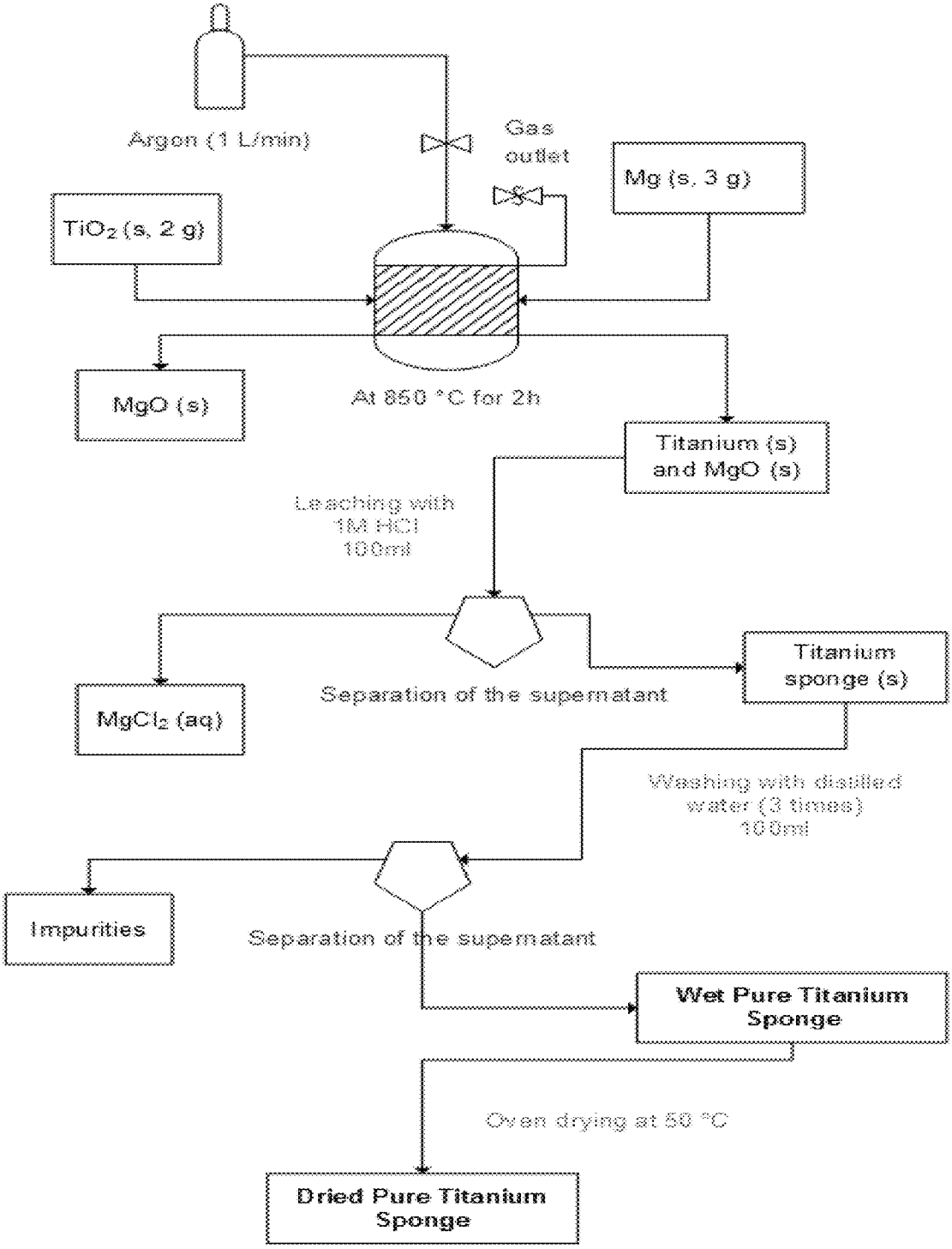
FIG. 2 is a process flow diagram of the Ti extraction process

With reference to FIGS. 1 and 2, in an embodiment, a bed of 2.00 g of ≥99% pure $TiO_2$ powder (obtained from Sigma Aldrich) is loaded onto a stainless steel ("SS") tray which is suspended over a bed of 3.00 g of ≥99% pure Mg powder (Mg was used in excess) loaded on a separate SS tray. (See, e.g., FIG. 1). In an example embodiment, the titanium oxide powder comprises $TiO_2$ nanopowder. In an example embodiment, titanium oxide powder comprises 95% titanium oxide. These trays are placed in a SS reaction chamber, which is sealed with a lid. The rim of the sealed container is covered by a ceramic paste to further seal the chamber. This reaction chamber is then placed in a furnace and, in some embodiments, the sealed chamber is filled with argon gas (e.g., as shown in FIG. 1) or another inert gas. The reaction chamber is then heated to ~850° C. The reaction is carried out for ~2 h, during which time the vapour pressure of Mg is ~$4.64\times 10^3$ Pa. In an example embodiment, one or both of the first tray and second tray are vibrated while the reaction vessel is heated. Afterwards, the reaction chamber is cooled to room temperature. The resulting product is leached overnight with dilute HCl (1 M, 100 mL) to remove the magnesium oxide. Next, the product is rinsed with distilled water to remove the acid residues and dried at 50° C. In an example embodiment, this washed titanium reaction product has a purity of greater than 99% titanium. An embodiment of this process flow is summarized in FIG. 2.

In still other embodiments, the reaction process described above is repeated at different temperatures, titanium oxide: Mg reactant molar ratios, and reaction times. In an embodiment, the reaction vessel comprises a rotating drum and the titanium oxide source is placed in the rotating drum and the Mg source comprises Mg vapour and the Mg vapour is purged into the rotating drum.

Finally, in some other embodiments, ultrasound sonication was used to aid the washing process in order to improve the removal of MgO from the product. For example, in some embodiments ultrasound sonication was used for ~2-5 minutes to aid in the washing process.

Characterization of Titanium Metal

The effects of reaction parameters such as temperature, reaction time, and reactant molar ratios on the nature and purity of the final product were investigated as described herein with reference to various figures.

Figure 3:
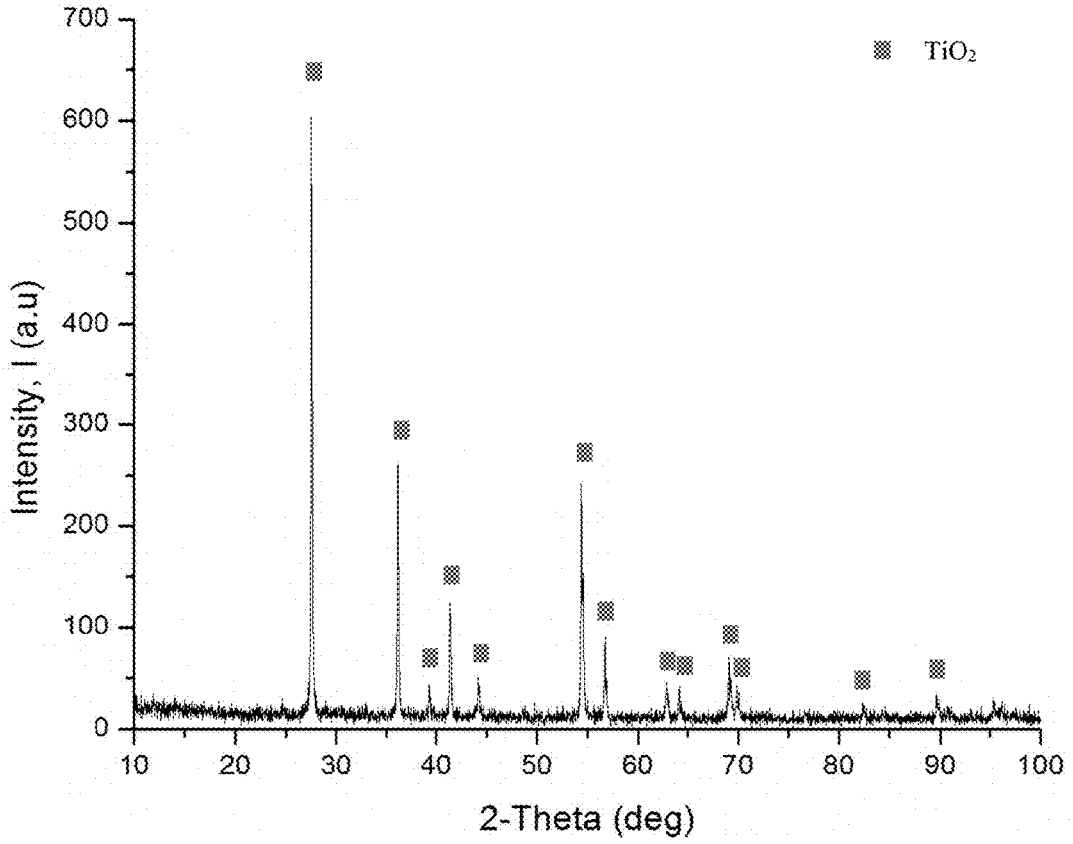
FIG. 3 is a powder X-ray diffraction pattern of $TiO_2$
Figure 4:
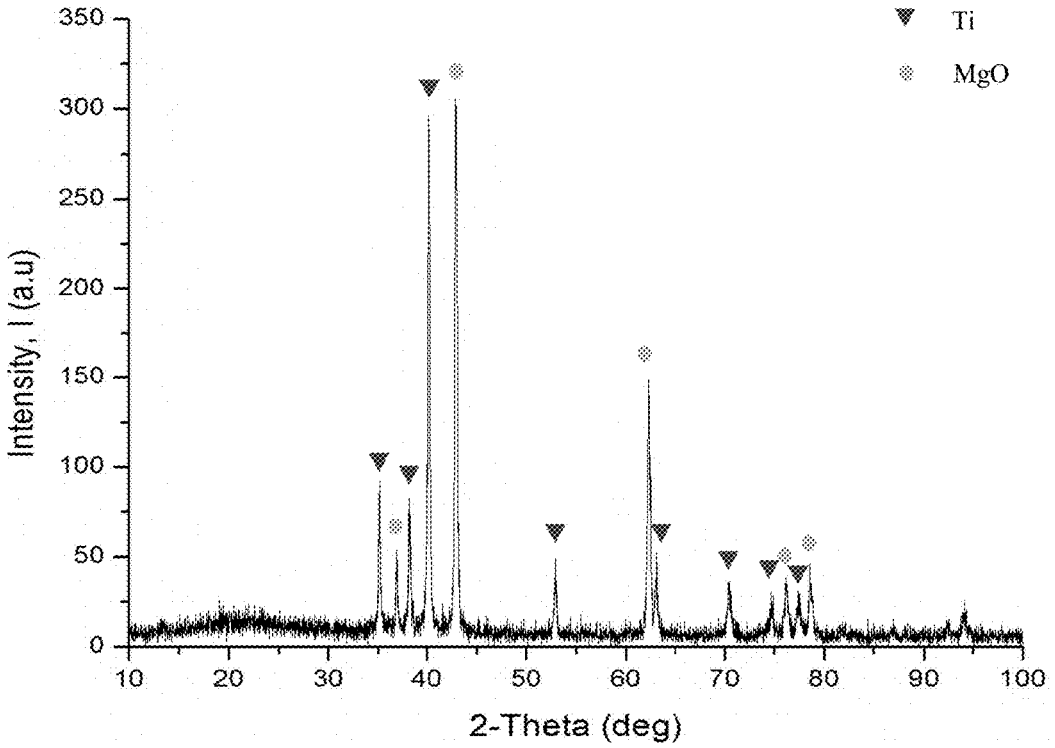
FIG. 4 is a powder X-ray diffraction patterns of the products obtained after the reduction of $TiO_2$ with Mg prior to leaching with dilute HCl
Figure 5:
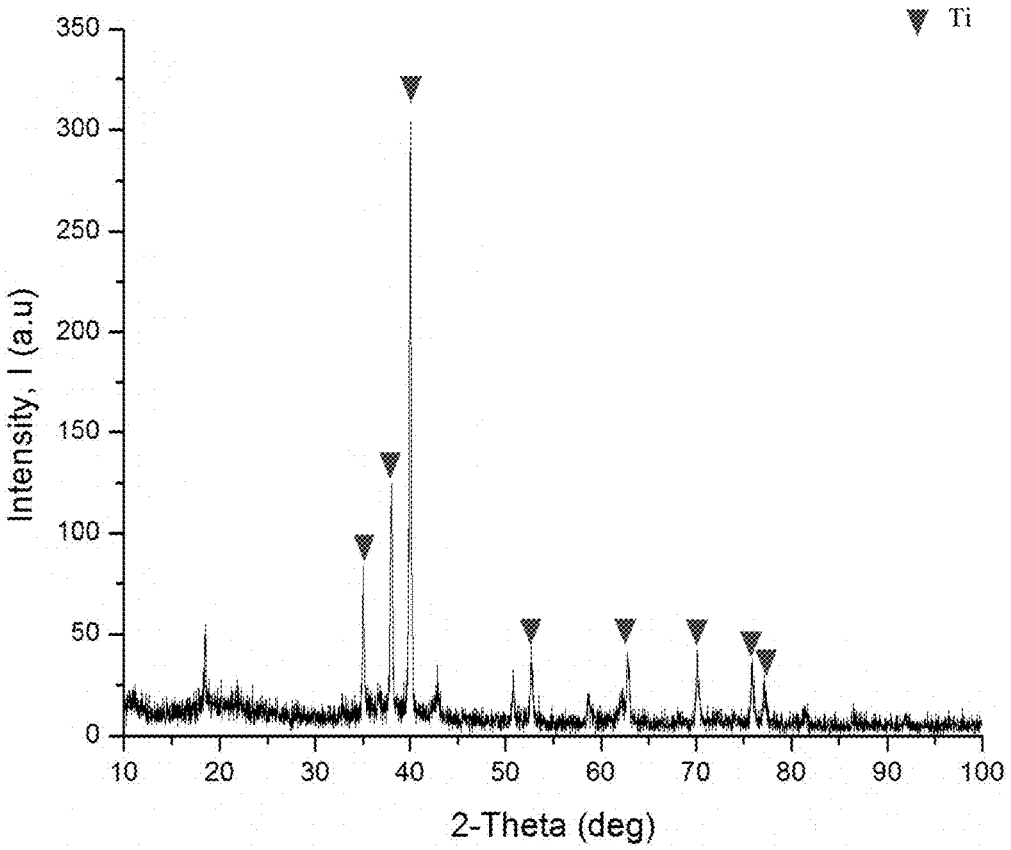
FIG. 5 is a powder X-ray diffraction pattern of the product obtained after the reduction of $TiO_2$ with Mg followed by leaching with dilute HCl

FIG. 3 is the powder X-ray diffraction (PXRD) pattern for pure $TiO_2$. The PXRD patterns of the product obtained when $TiO_2$ is reduced with Mg (850° C., 2 h, argon environment but before leaching with dilute HCl clearly showed peaks related to Ti metal and as well as MgO (FIG. 4). Only Ti peaks were observed after the product was leached with dilute HCl indicating that the MgO had been completely removed (FIG. 5). Furthermore, there were no residual $TiO_2$ peaks observed and there was no formation of any other titanium sub-oxides.

Table 1 (a) is the elemental analysis data based on energy dispersive X-ray spectroscopy (EDX data) of the product before leaching in dilute HCl acid. The EDX data before leaching confirms that there is a high percentage of MgO with a 35.12 wt % of magnesium and 28.16 wt % of oxygen and a low percentage of Ti of 36.72 wt %.

TABLE 1(a)

EDX data after the reaction of $TiO_2$ with Mg (prior to leaching in acid)

| Element Line | Net Counts | Net Counts Error | Weight % | Weight % Error | Atom % |
|---|---|---|---|---|---|
| O K | 23879 | +/−625 | 28.16 | +/−0.36 | 33.33 |
| Mg K | 117867 | +/−1098 | 35.12 | +/−0.16 | 36.42 |
| Ti K | 33747 | +/−539 | 36.72 | +/−0.29 | 19.51 |
| Total | | | 100.00 | | 100.00 |

The EDX data of the product after leaching shown in table 1 (b) indicates titanium with a high percentage of 99.37 wt % and a low oxygen percentage of 0.63 wt %. The oxygen detected may be due to the formation of an oxide layer over the Ti metal.

TABLE 1(b)

EDX data after the reaction of $TiO_2$ with Mg (after leaching in acid)

| Element Line | Net Counts | Net Counts Error | Weight % | Weight % Error | Atom % |
|---|---|---|---|---|---|
| O K | 397 | +/−126 | 0.63 | +/−0.09 | 1.83 |
| Ti K | 350246 | +/−1903 | 99.37 | +/−0.27 | 98.17 |
| Total | | | 100.00 | | 100.00 |

Figure 6:
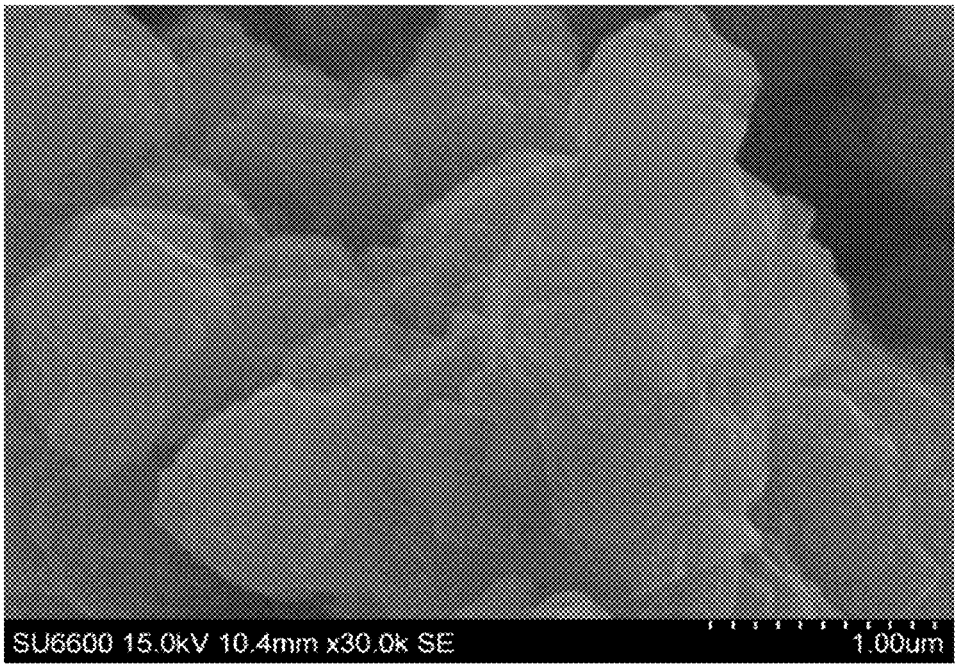
FIG. 6 shows SEM images of the products obtained when $TiO_2$ is reacted with Mg vapour (a) before leaching and (b) after leaching with dilute HCl
Figure 6:
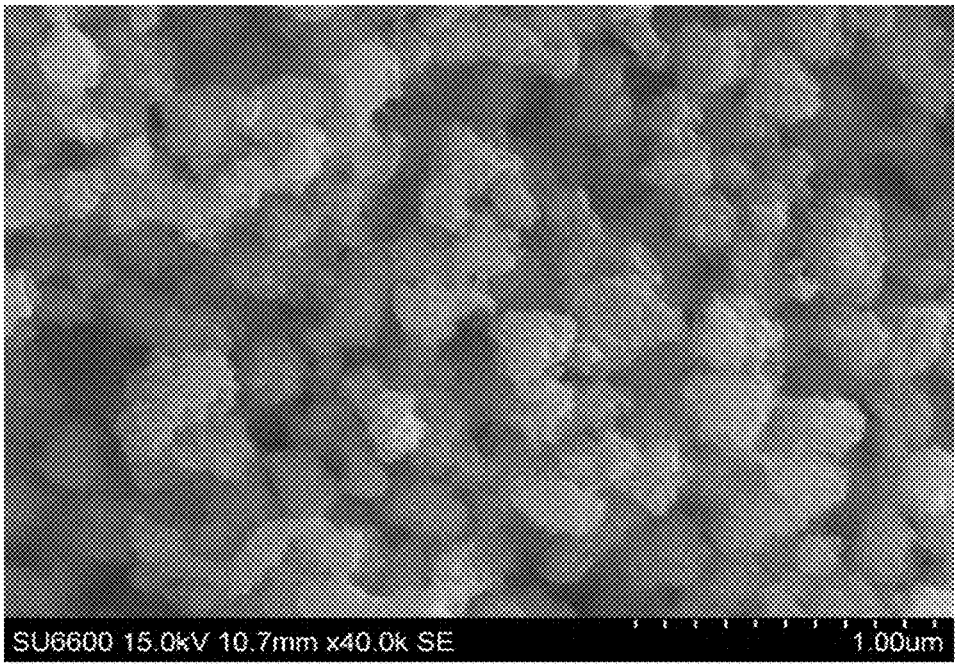

FIG. 6 at (a) shows an SEM image of the product before leaching with dilute HCl acid. The morphology of the product before leaching shows a plate like formation which is mainly due to the presence of crystalline MgO. FIG. 6 at (b) shows an SEM image of the product after leaching in acid. In this image Ti particles are observed, and the particle size of the product has been reduced after leaching when compared with the image taken before leaching. This indicates that MgO was produced as a layer over the produced Ti particles, and that layer has been washed away through the acid leaching step.

Figure 7:
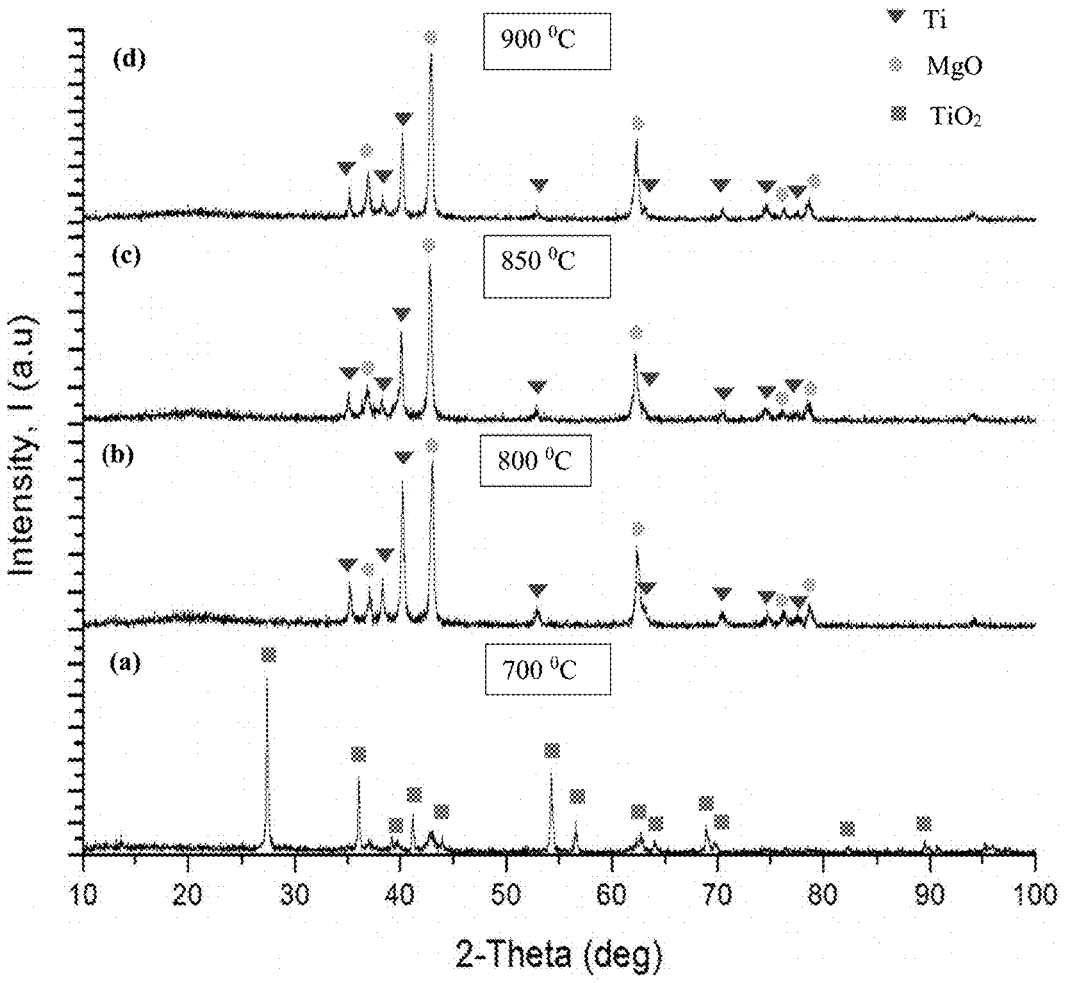
FIG. 7 shows powder X-ray diffraction patterns of the products obtained when the $TiO_2$ reduction process is performed at the following temperatures: (a) 700° C. (b) 800° C. (c) 850° C. and (d) 900° C. before leaching with dilute HCl
Figure 8:
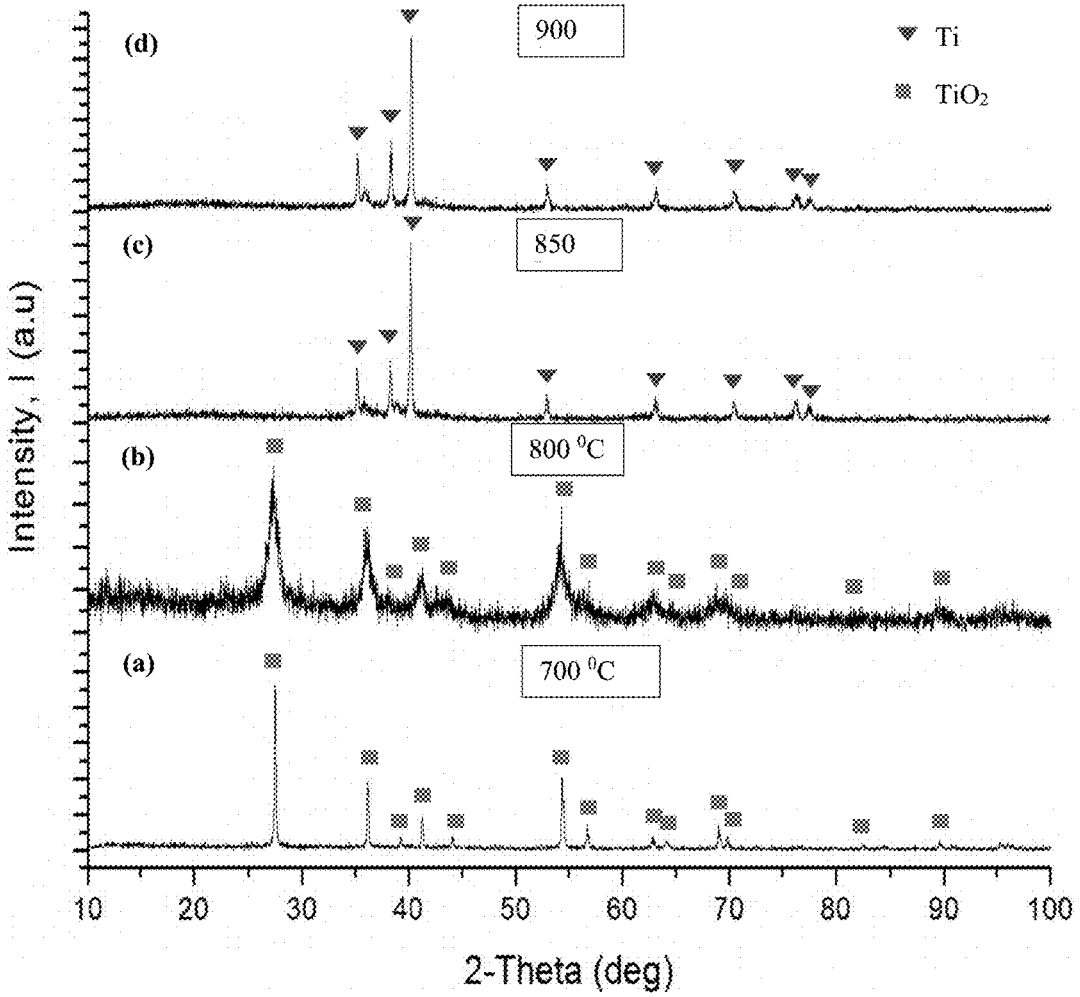
FIG. 8 shows powder X-ray diffraction patterns of the products obtained when the $TiO_2$ reduction process is performed at the following temperatures: (a) 700° C. (b) 800° C. (c) 850° C. and (d) 900° C. after leaching with dilute HCl

FIG. 7 shows the PXRD patterns obtained for the products received by varying the temperature of the Mg reduction process from 700° C., 800° C., 850° C., and 900° C. FIG. 8 shows the PXRD patterns after removing Mg impurities by washing with dilute HCl acid. As observed by the PXRD patterns the reaction carried out at 700° C. has led to an incomplete conversion into Ti metal. As shown by the patterns for both figures there is a significant amount of starting materials left in the sample for the reaction carried out at 700° C. According to the PXRD patterns at all other temperatures (800° C., 850° C., and 900° C.) a complete reduction of $TiO_2$ into Ti metal has occurred.

Figure 9:
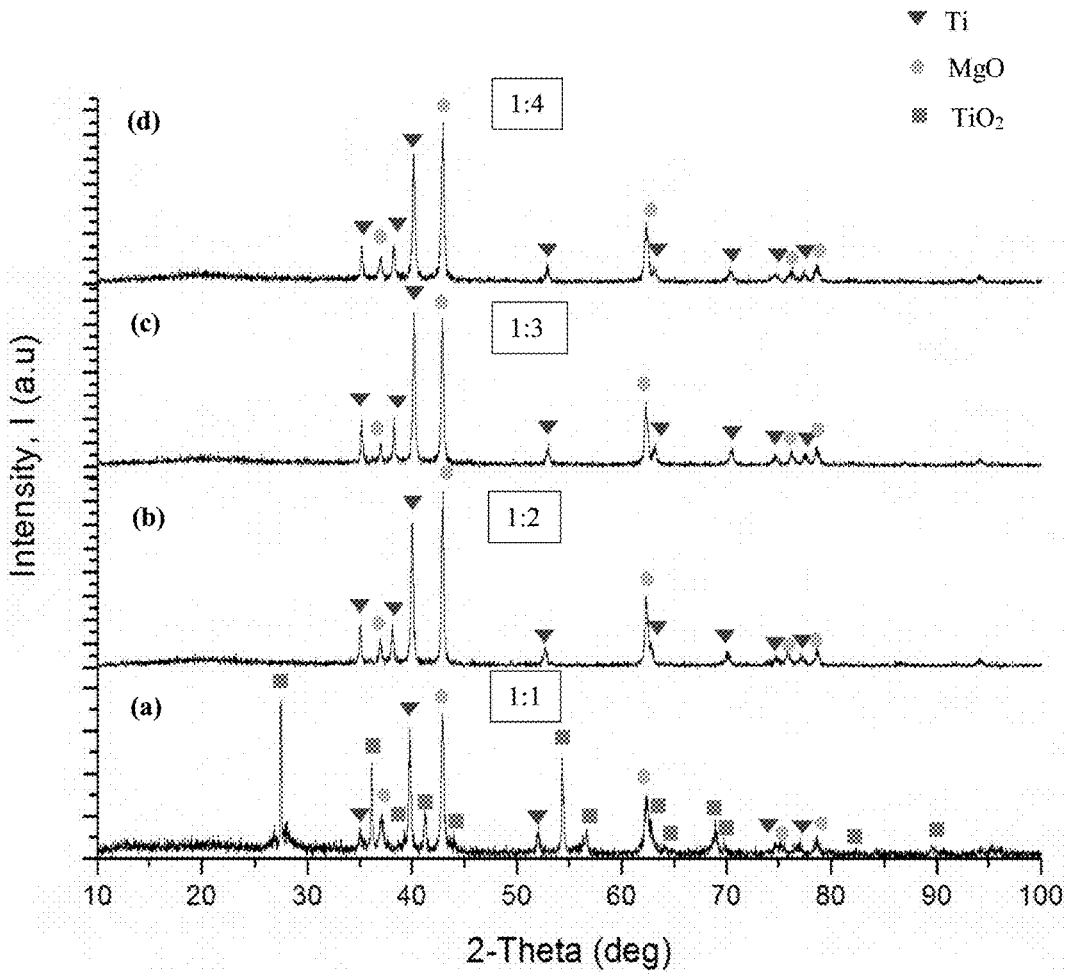
FIG. 9 shows powder X-ray diffraction patterns of the products obtained when the $TiO_2$ reduction process is performed with the following $TiO_2$ to Mg molar ratios: (a) 1:1 (b) 1:2 (c) 1:3 and (d) 1:4, at 850° C. for 2 h before leaching with dilute HCl
Figure 10:
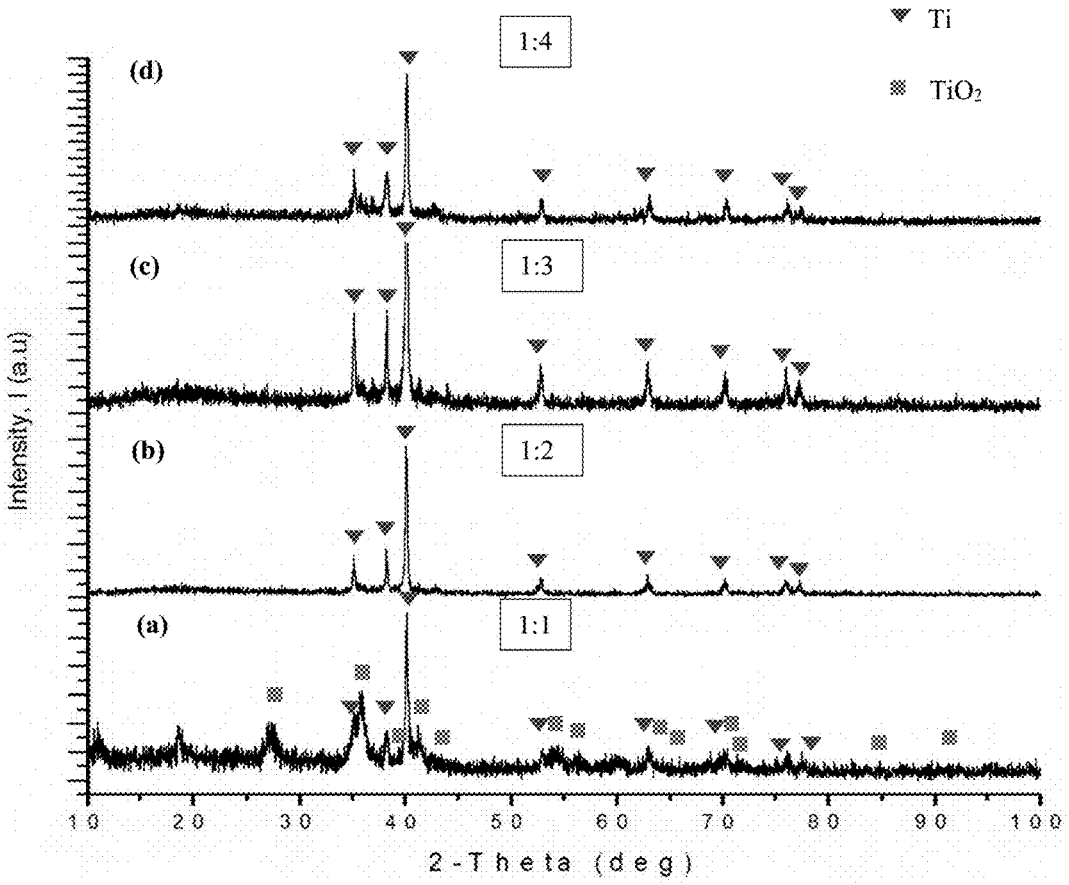
FIG. 10 shows powder X-ray diffraction patterns of the products obtained when the $TiO_2$ reduction process is performed with the following $TiO_2$ to Mg molar ratios: (a) 1:1 (b) 1:2 (c) 1:3 and (d) 1:4, at 850° C. for 2 h after leaching with dilute HCl

The amount of Mg required was tested at different molar ratio of reactants ($TiO_2$ to Mg powder) at 850° C., for 2 h. As shown in FIGS. 9 and 10, at the ratio of $TiO_2$ to Mg 1:1, Ti peaks were observed with some unreacted $TiO_2$ The observations suggest that the optimum molar ratio of $TiO_2$:Mg is 1:2 for complete conversion of $TiO_2$ to Ti metal. At higher molar ratios a significant amount of tightly bound Mg remained in the product, which was difficult to remove with simple acid washing steps.

Figure 11:
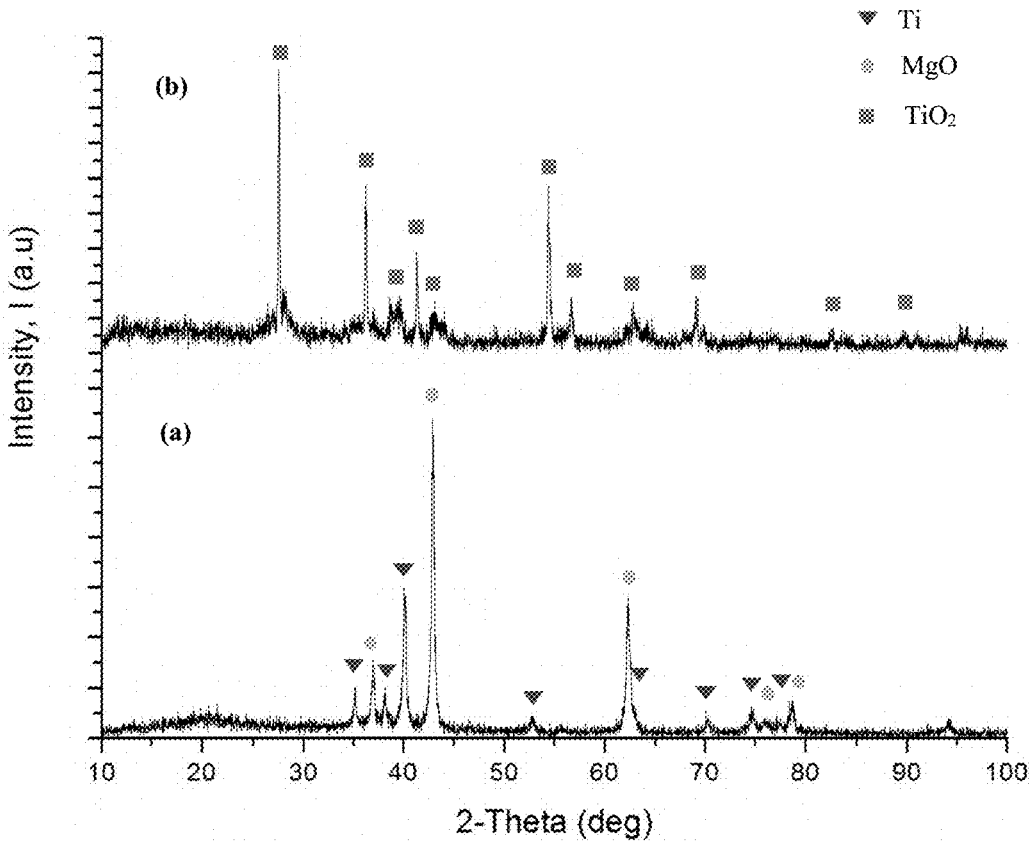
FIG. 11 shows powder X-ray diffraction patterns of the products obtained when the $TiO_2$ reduction process is performed at a reaction time of 0.5 h (a) before leaching (b) after leaching, at 850° C. with 1:2 molar ratio of $TiO_2$ to Mg
Figure 12:
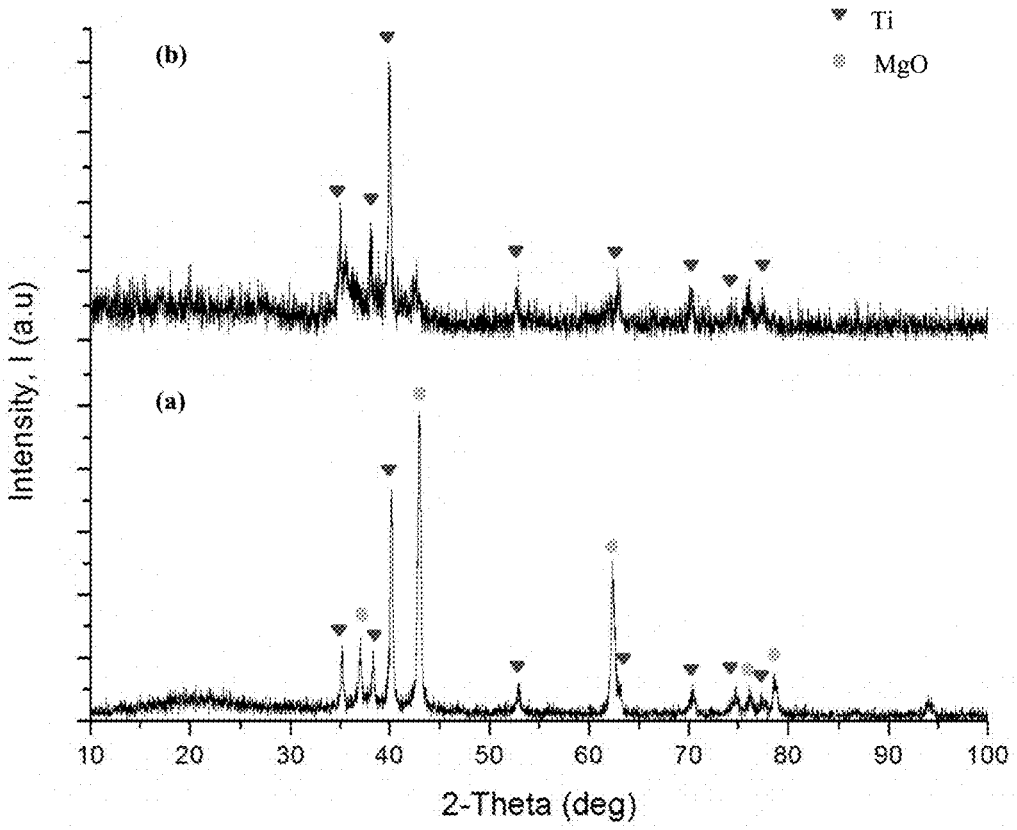
FIG. 12 shows powder X-ray diffraction patterns of the products obtained when the $TiO_2$ reduction process is performed at a reaction time of 1 h (a) before leaching (b) after leaching, at 850° C. with 1:2 molar ratio of $TiO_2$ to Mg

FIGS. 11 and 12 show the PXRD patterns of products related to reactions carried out for different times at 850° C. with 1:2 molar ratio of reactants. In the embodiments shown, the reaction carried out for 0.5 h showed some unreacted $TiO_2$. However the reaction carried for 1 h lead to formation of Ti metal without the presence of any sub-oxide peaks of Ti.

Figure 13:
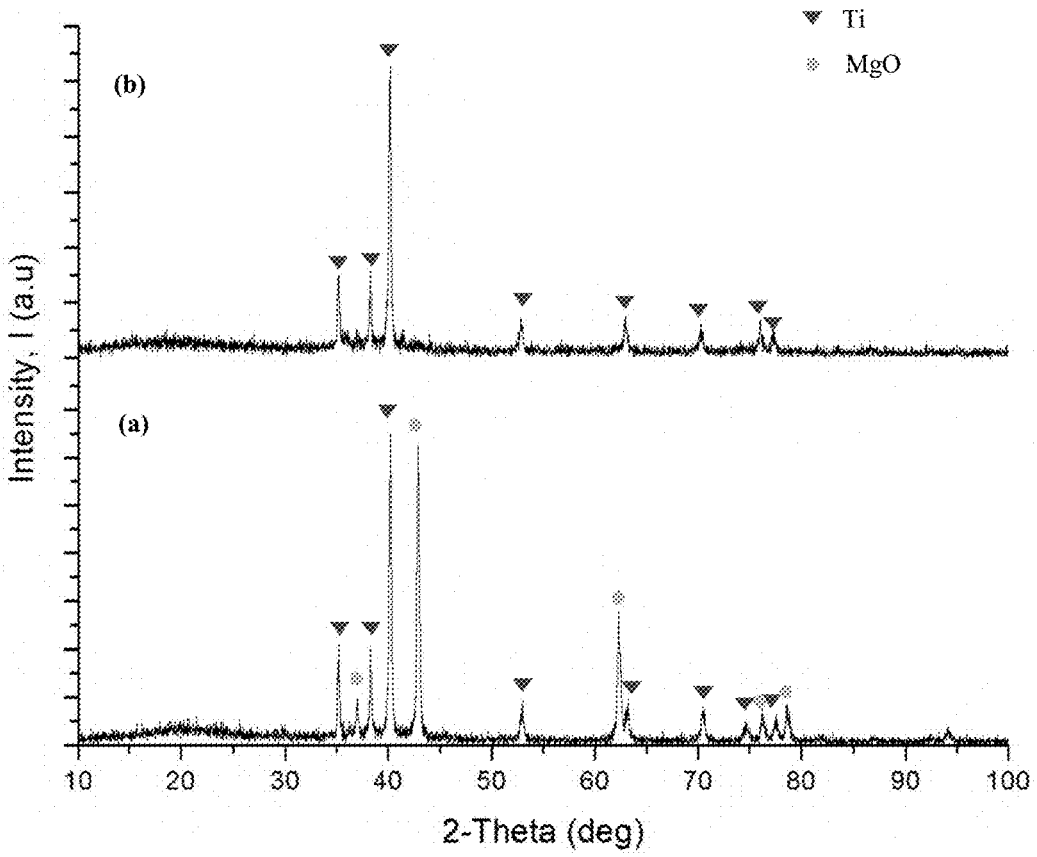
FIG. 13 shows powder X-ray diffraction patterns of $TiO_2$ reduction products obtained by leaching with dilute HCl acid under sonication (a) before leaching (b) after leaching

In another embodiment, the product obtained by the reduction of $TiO_2$ with Mg (1:2 ratio, 2 h, 850° C.) was washed with a dilute HCl (100 mL) in the presence of ultrasound sonication (at an amplitude of 80, 3 minutes, two times). The PXRD patterns of the resulting product before and after leaching are given in FIG. 13.

Figure 14:
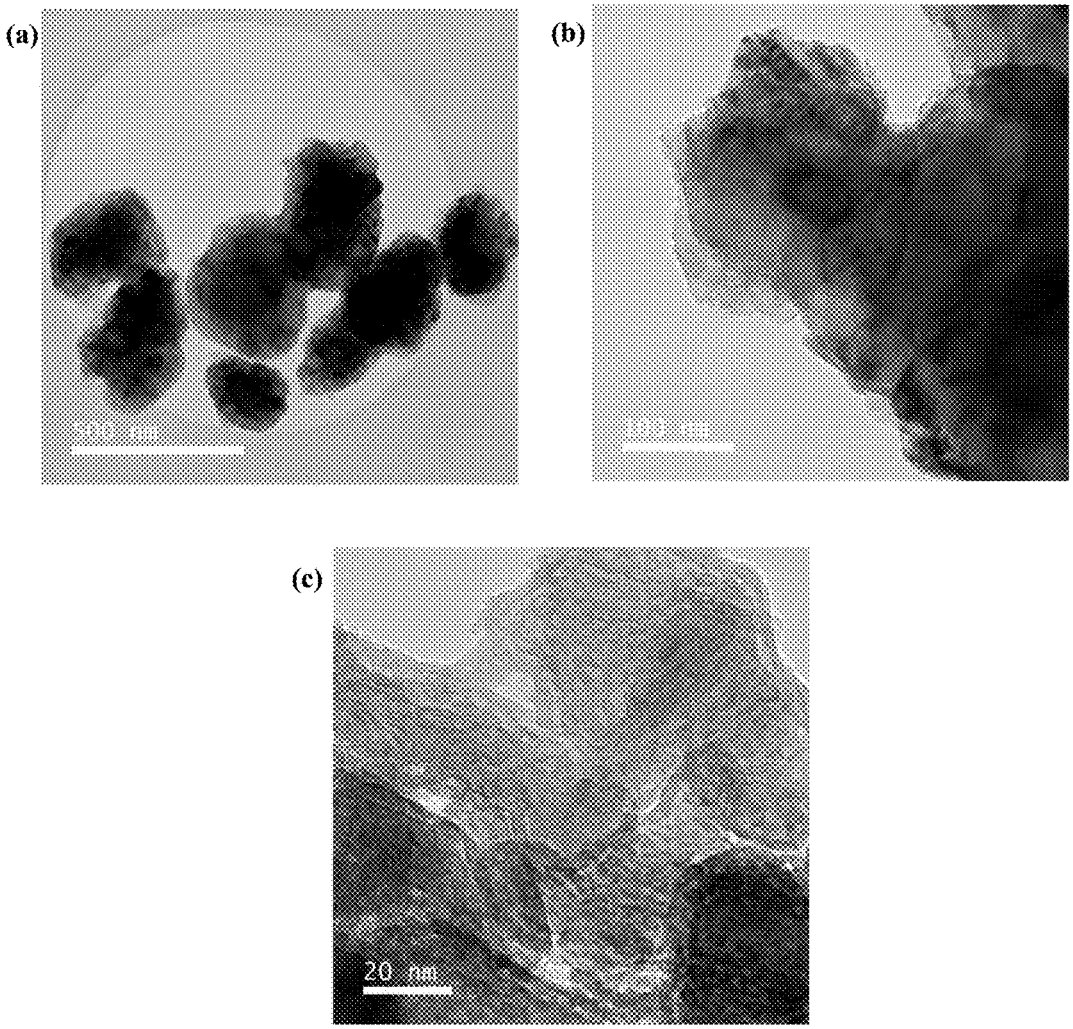
FIG. 14 shows transmission electron microscopy images of $TiO_2$ reacted with Mg vapour (a) before leaching with dilute HCl acid at low resolution, (b) before leaching with dilute HCl acid at high resolution, and (c) after leaching with dilute HCl at high resolution.

Further structural studies obtained on a product from a preferred embodiment process (temperature 850° C., time 2 h, Mg:$TiO_2$ molar ratio 2:1, ultrasound assisted dilute HCl washing) were carried out using transmission electron microscopic imaging (TEM), electron energy loss spectroscopy (EELS) and energy dispersive spectroscopy (EDX) spectral analysis and imaging. According to the TEM imaging (FIGS. 14 (*a*) and (*b*)) the product obtained after reacting $TiO_2$ with Mg vapour results in a coshell product where the Ti particles are covered with MgO layer where there is a clear image contrast (area related to Ti metal appears darker than those of MgO). This observation suggests that lattice level interactions have occurred when the Mg vapour penetrates into the lattice of the $TiO_2$. When the Ti—MgO product is washed with dilute HCl acid the image contrast no longer appears suggesting the complete removal of MgO.

Figure 15:
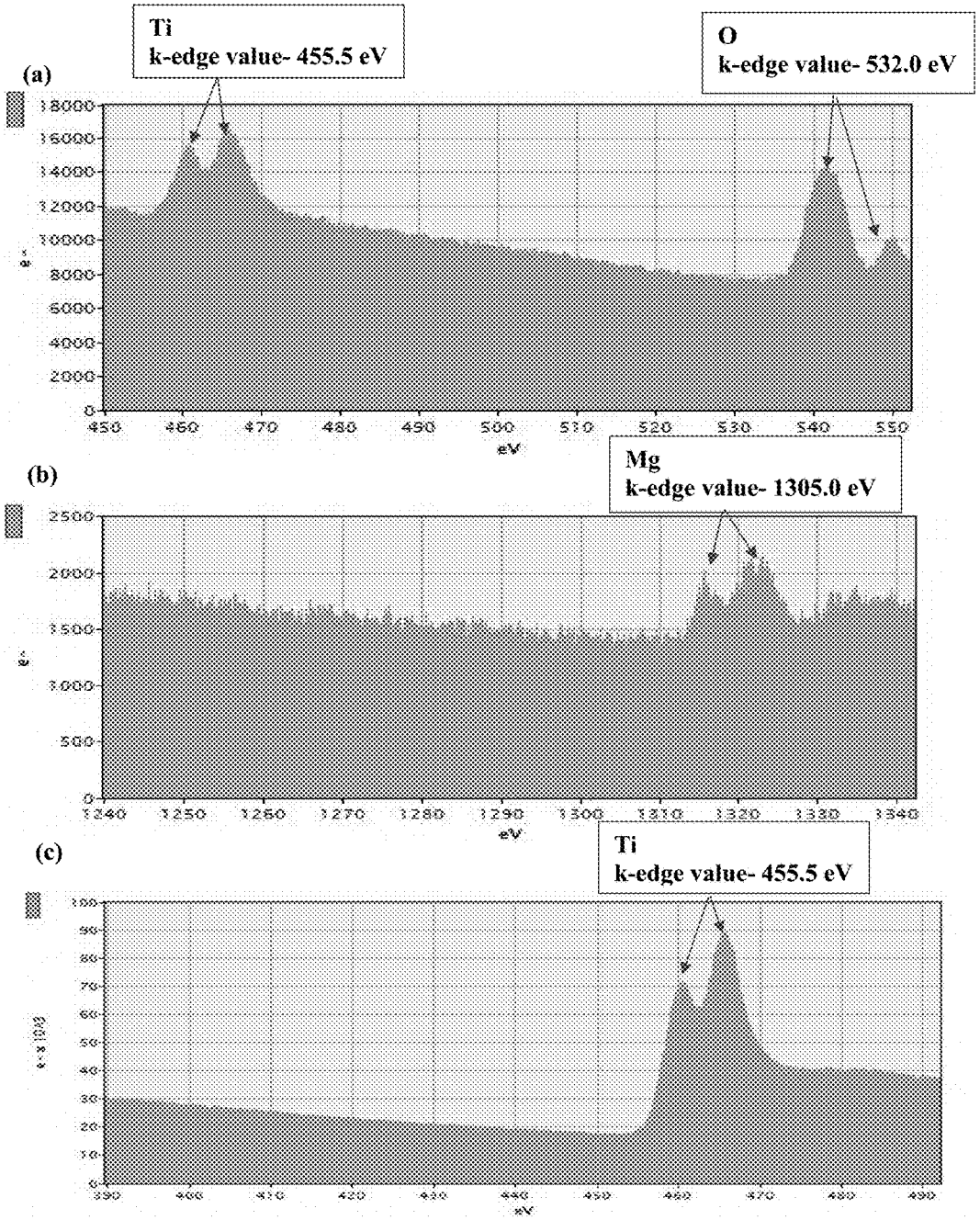
FIG. 15 shows electron energy loss spectroscopy results of $TiO_2$ reacted with Mg vapour (a) before leaching with dilute HCl showing Ti and O peaks, (b) before leaching with dilute HCl showing Mg peaks, and (c) after leaching with dilute HCl showing only Ti peaks

According to the EELS results, Ti, O and Mg K-edge peaks at 455.5 eV, 532.0 eV, 1305.0 eV respectively, are observed in the Ti—MgO co-shell product. (FIG. 15 at (a) and (b)). When the product is leached with dilute HCl acid both O and Mg K-edge peaks disappear leaving only the Ti K-edge peaks. (FIG. 15 at (c))

Figure 16:
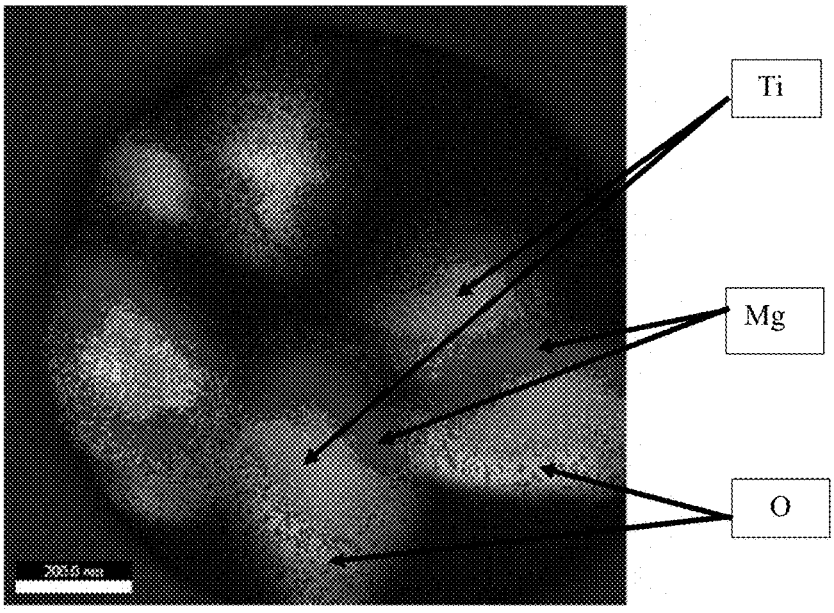
FIG. 16 shows energy dispersive X-ray diffraction results of $TiO_2$ reacted with Mg vapour (a) before leaching with dilute HCl acid showing Ti in the core of the particle and Mg and O as a coating around the Ti core, (b) $TiO_2$ reacted with Mg vapour after leaching with dilute HCl acid showing Ti and an oxidized layer of oxygen around the Ti.
Figure 16:
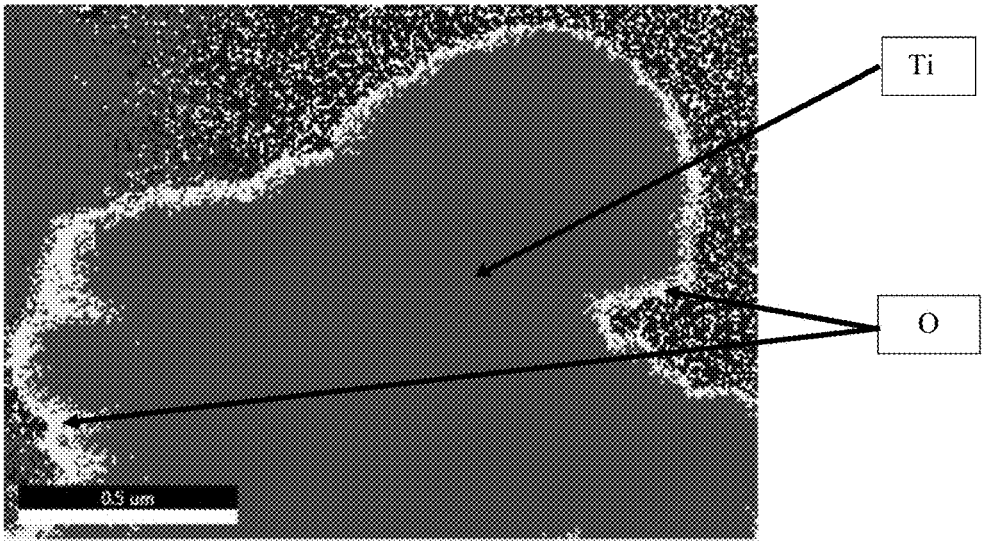

MgO coated Ti crystals are clearly observed in the EDX elemental mapping image shown in FIG. 16 at (a) while any areas elated to Mg is not observed in the product received after leaching with dilute HCl acid (FIG. 16 at (b)). Only a very thin layer of oxide is formed on the Ti crystal accounting for the presence of ~0.4% of oxygen in the EDX analysis.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent presently preferred embodiments of the invention and are therefore representative of the subject matter broadly contemplated by the present invention. It is further understood that the scope of the present invention fully encompasses other embodiments that may become obvious to those skilled in the art and that the scope of the present invention is accordingly limited by nothing other than the appended claims.

What is claimed is:

1. A method of producing titanium metal from titanium oxides using a single reduction step, the method comprising:

a. providing a composition comprising a titanium oxide source in a reaction vessel, wherein the composition comprising a titanium oxide source comprises titanium oxide powder;

b. providing a composition comprising a Mg source in the reaction vessel, wherein (i) the molar ratio of titanium oxide of the titanium oxide source to Mg of the Mg source is 1:x where x is greater than 1.0 and (ii) the composition comprising the Mg source comprises Mg powder;

c. heating the reaction vessel to an internal temperature of between 850° C. and 1000° C. until a vapour of Mg is produced for at least 30 minutes to form a reaction product; and d. washing said reaction product with one or more washing media to form a washed titanium reaction product.

2. The method of claim 1 wherein the composition comprising a titanium oxide source comprises a natural rutile source.

3. The method of claim 1 wherein the composition comprising a titanium oxide source comprises an iron removed ilmenite sand.

4. The method of claim 1 wherein the titanium oxide powder comprises $TiO_2$ nanopowder.

5. The method of claim 1 wherein the titanium oxide powder is a sub-oxide of Ti.

6. The method of claim 1 wherein the titanium oxide powder comprises 95% titanium oxide.

7. The method of claim 1 wherein the Mg powder comprises Mg nanopowder.

8. The method of claim 1 wherein the Mg powder comprises 99% Mg.

9. The method of claim 1 wherein the washed titanium reaction product has a purity of greater than 99% titanium.

10. The method of claim 1 wherein the reaction vessel is heated to an internal temperature of between 850° C. and 1000° C. for about 2 hours to form a reaction product.

11. The method of claim 1 wherein the reaction vessel is heated to an internal temperature of about 850° C. for about 2 hours to form a reaction product.

12. The method of claim 1 wherein the one or more washing media are selected from the group consisting of dilute HCl, dilute $HNO_3$, dilute $H_2SO_4$ and deionized water.

13. The method of claim 1 wherein the method further comprises providing inert gas in said reaction vessel.

14. The method of claim 13 wherein said inert gas is argon.

15. The method of claim 1 wherein the reaction vessel contains a first tray upon which the titanium oxide source is placed and a second tray upon which the Mg source is placed.

16. The method of claim 15 wherein one or both of the first tray and second tray are vibrated while the reaction vessel is heated.

17. The method of claim 1 wherein the reaction vessel further comprises a rotating drum and wherein the titanium oxide source is placed in the rotating drum and wherein the Mg source comprises Mg vapour and wherein the Mg vapour is purged into the rotating drum.

18. A method of producing titanium-iron alloy from ilmenite comprising:

a. providing a composition comprising ilmenite source in a reaction vessel;

b. providing a composition comprising a Mg source in the reaction vessel, wherein (i) the molar ratio of titanium oxide of the ilmenite source to Mg of the Mg source is 1:x where x is greater than 1.0 and (ii) the composition comprising the Mg source comprises Mg powder;

c. heating the reaction vessel to an internal temperature of between 850° C. and 1000° C. until a vapour of Mg is produced for at least 30 minutes to form a reaction product;

d. washing said reaction product with one or more washing media.

* * * * *